US011236551B2

(12) United States Patent
Fredriksen et al.

(10) Patent No.: US 11,236,551 B2
(45) Date of Patent: Feb. 1, 2022

(54) WIRED PIPE AND METHOD FOR MAKING

(71) Applicant: Reelwell, A.S., Sola (NO)

(72) Inventors: Kyrre Delin Fredriksen, Stavanger (NO); Espen Alhaug, Stavanger (NO)

(73) Assignee: Reelwell, A.S., Sola (NO)

( * ) Notice: Subject to any disclaimer, the term of this patent is extended or adjusted under 35 U.S.C. 154(b) by 650 days.

(21) Appl. No.: 15/957,368

(22) Filed: Apr. 19, 2018

(65) Prior Publication Data

US 2019/0119990 A1 Apr. 25, 2019

Related U.S. Application Data

(63) Continuation of application No. PCT/IB2016/056258, filed on Oct. 18, 2016.

(60) Provisional application No. 62/363,353, filed on Jul. 18, 2016, provisional application No. 62/243,371, filed on Oct. 19, 2015.

(51) Int. Cl.

| | |
|---|---|
| ***E21B 17/02*** | (2006.01) |
| ***E21B 17/00*** | (2006.01) |
| *E21B 17/042* | (2006.01) |

(52) U.S. Cl.

CPC ..... *E21B 17/028* (2013.01); *E21B 17/003* (2013.01); *E21B 17/042* (2013.01)

(58) Field of Classification Search

CPC .... E21B 17/028; E21B 17/003; E21B 17/042; E21B 17/0285

USPC ..... 29/888, 429, 455.1, 454, 592.1, 888.02, 29/888.01, 525.11, 458, 825

See application file for complete search history.

(56) References Cited

U.S. PATENT DOCUMENTS

| | | | | |
|---|---|---|---|---|
| 2,924,245 | A * | 2/1960 | Wilson | F16L 59/14 138/149 |
| 3,325,191 | A * | 6/1967 | Yates | F16L 13/0263 285/55 |
| 2003/0075361 | A1* | 4/2003 | Terry | E21B 47/01 175/61 |
| 2005/0207279 | A1* | 9/2005 | Chemali | E21B 17/028 367/83 |
| 2008/0041575 | A1 | 2/2008 | Clark et al. | |

(Continued)

OTHER PUBLICATIONS

Full English translation of a Chinese Third Office Action dated Jan. 19, 2020, for Chinese Patent Application No. 201680074351.4.

(Continued)

*Primary Examiner* — Peter Dungba Vo
*Assistant Examiner* — Kaying Kue
(74) *Attorney, Agent, or Firm* — Richard A. Fagin

(57) ABSTRACT

A method for making a wired drill pipe joint includes forming an electrically conductive material into a structure that is radially expandable to conform to an interior of the pipe joint substantially without plastic deformation of the electrically conductive material. An electrical connector is coupled to each longitudinal end of the formed electrically conductive material to form an electrical conductor assembly. An interior of the pipe joint is coated with an electrically insulating material. The electrical conductor assembly is inserted into the pipe joint. The electrically conductive material is radially expanded to conform to an interior surface of the pipe joint wherein a bonding material is applied to the interior wall of the pipe joint.

33 Claims, 13 Drawing Sheets

(56) References Cited

U.S. PATENT DOCUMENTS

2008/0066961 A1* 3/2008 Aivalis ..... E21B 17/04 175/50
2010/0264646 A1* 10/2010 Follini ..... E21B 17/028 285/119
2011/0094729 A1 4/2011 Braden et al.
2013/0233587 A1* 9/2013 Varkey ..... B05D 7/14 174/110 SR
2013/0265171 A1 10/2013 Hqy
2014/0144699 A1* 5/2014 Mueller ..... E21B 17/028 174/77 R
2014/0291015 A1* 10/2014 Floerke ..... H05K 9/0098 174/70 R
2014/0352941 A1* 12/2014 Mueller ..... E21B 17/003 166/65.1
2014/0361496 A1* 12/2014 Miyashita ..... F16L 27/053 277/608
2015/0009040 A1 1/2015 Bowles et al.
2015/0194239 A1* 7/2015 Mueller ..... E21B 17/003 174/113 R
2016/0319607 A1* 11/2016 Maclean ..... E21B 19/22
2017/0110220 A1* 4/2017 Romer ..... D07B 1/147

OTHER PUBLICATIONS

Chinese Third Office Action dated Jan. 19, 2020, for Chinese Patent Application No. 201680074351.4.
English translation for the first two pages of the Chinese Third Office Action dated Jan. 19, 2020, for Chinese Patent Application No. 201680074351.4.
International Search Report and Written Opinion, International Application No. PCT/IB2016/056258 dated Mar. 16, 2017.
European Examination Report dated Sep. 30, 2019, European Patent Application No. 16791097.5.

* cited by examiner

WIRED PIPE AND METHOD FOR MAKING

CROSS REFERENCE TO RELATED APPLICATIONS

Continuation of International (PCT) Application No. PCT/IB2016/056258 filed on Oct. 18, 2016. Priority is claimed from U.S. Provisional Application No. 62/363,353 filed on Jul. 18, 2016 and from U.S. Provisional Application No. 62/243,371 filed on Oct. 20, 2015. All three of the foregoing applications are incorporated herein in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to pipe used in the construction of subsurface wellbores in which an electrical conductor insulated from the pipe is provided. More specifically, the disclosure relates to specific structures for an insulated electrical conductor disposed in a pipe segment (a "joint" of the pipe) and to methods for making such pipe joints.

So called "wired" drill pipe is desirable for purposes of providing electrical power to and/or communicating signals from instruments disposed along a drill pipe used to drill subsurface wellbores. The instruments may be disposed proximate the bottom end of assembled joints of drill pipe (collectively referred to as a "drill string") during wellbore drilling and associated operations as well as at other selected longitudinal positions along the drill string. Signals may also be communicated from the equipment disposed at the surface to the instruments in the wellbore using such wired drill pipe.

Wired drill pipe is made in two different general types of structure. One such structure comprises a conduit inside the interior of a pipe joint or within the wall of a pipe joint. The conduit contains insulated electrical conductors that are terminated by electromagnetic couplings at each longitudinal end of the pipe joint. The electromagnetic couplings are each placed proximate to another such electromagnetic coupling when joints of the drill pipe are threadedly connected end to end. One such wired drill pipe structure is described in U.S. Pat. No. 6,641,434 issued to Boyle et al. The other general structure comprises an electrical conductor that is insulated from the metal structure of the pipe joint and is coupled to the electrical conductor in adjacent pipe joints using various forms of galvanic electrical contacts. One such wired drill pipe structure is described in U.S. Pat. No. 4,557,538 issued to Chevalier.

A desirable feature of wired pipe, including, e.g., drill pipe, riser and casing having galvanically connected electrical conductors is that such wired pipe can transmit substantial electrical power as well as communicate signals. Such wired pipe has proven difficult to manufacture and may have less than ideal electrical and mechanical properties.

DETAILED DESCRIPTION

Figure 1:
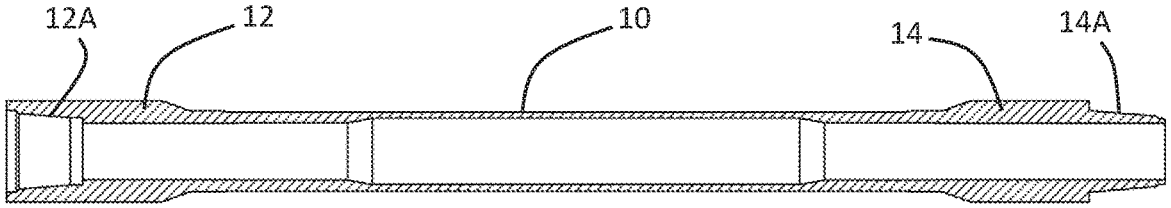
FIG. 1 shows an industry standard drill pipe joint prior to any manufacturing steps according to the present disclosure.

FIG. 1 shows an industry standard drill pipe segment or "joint" 10 prior to any manufacturing acts according to the present disclosure. The joint 10 may be made from steel or other high strength metal. A "tool joint" or threaded connector is disposed at each longitudinal end of the joint 10. The tool joints are shown first at 12, which is referred to as a "box" connector and has female threads 12A on an interior surface thereof. The other tool joint, shown at 14, has male threads and may be referred to as a "pin." The box 12 is configured for mating to the "pin" connector 14 using male threads 14A formed on an exterior surface of the pin 14 when two joints 10 are coupled end to end. Thus, each joint 10 may have a box connector 12 at one end and a pin connector 14 at the other end. While the present example embodiment is described in terms of drill pipe, it should be understood that wired pipe according to the present disclosure is not limited to drill pipe but may include, for example and without limitation, casing, tubing, riser and line pipe.

Figure 2:
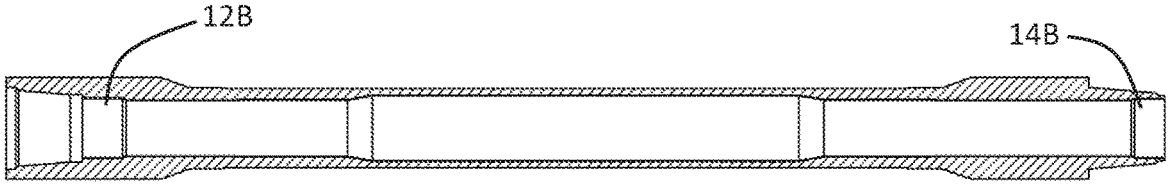
FIG. 2 shows the pipe joint of FIG. 1 with recesses formed therein for receiving electrical connectors.

FIG. 2 shows the pipe joint of FIG. 1 with recesses 12B, 14B formed in the interior of the box connector 12 and the pin connector 14, respectively, for receiving electrical connectors to be further explained below. The recesses 12B, 14B may be formed by machining of any type known in the art.

Figure 3A:
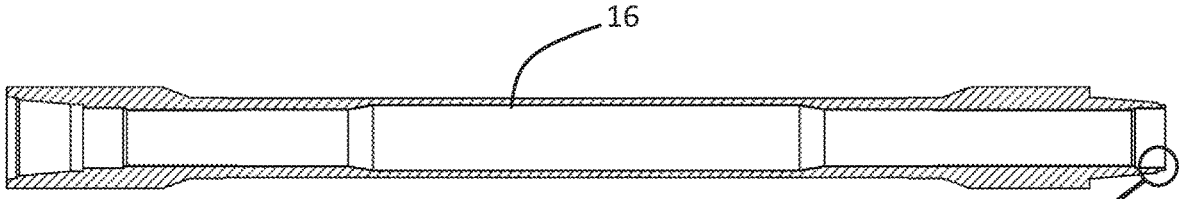
FIG. 3A shows the pipe joint of FIG. 2 wherein an electrically insulating material is applied to an interior surface of the pipe joint.
Figure 3B:
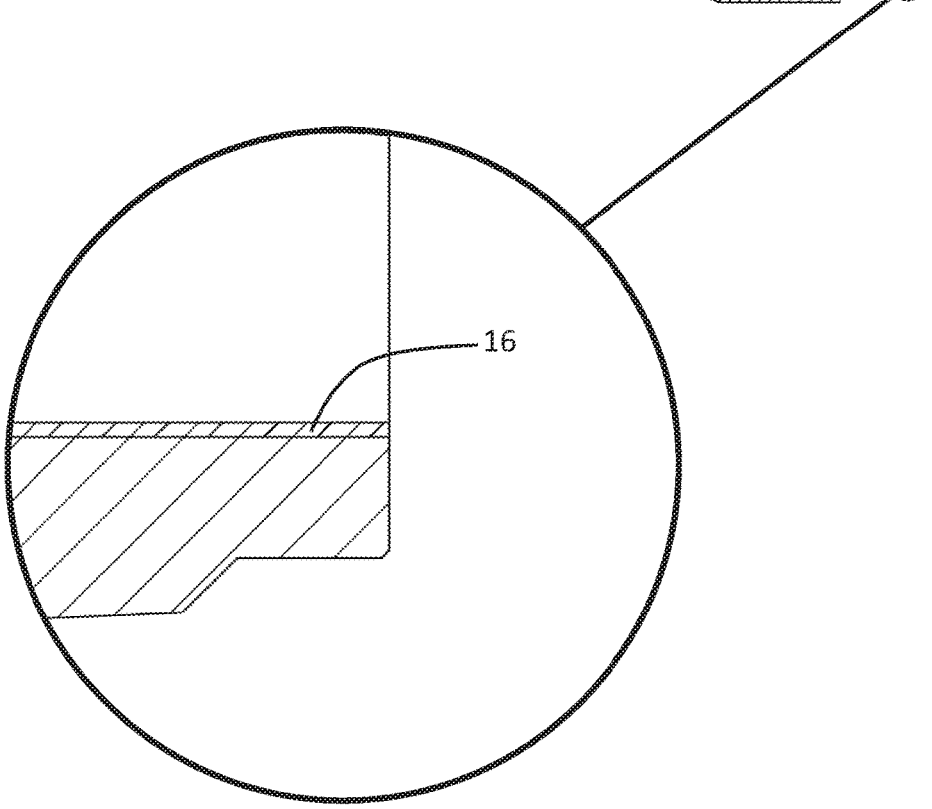
FIG. 3B shows the insulator and interior of the pipe joint in more detail.

FIG. 3A shows the pipe joint of FIG. 2 wherein an electrically insulating material 16 is applied to an interior surface of the pipe joint 10. The electrically insulating material 16 may be, for example and without limitation, thermoplastic, thermoset plastic, silicone, epoxy or any other flexible, electrically insulating material. In some embodiments, dielectric properties of the insulating material 16 and its thickness may be selected such that the fully assembled pipe joint 10 has selected electrical properties, e.g., capacitance and inductance per unit length. A more detailed view of the electrically insulating material inside the pipe joint 10 at the pin end (14B in FIG. 2) is shown in FIG. 3B.

Figure 4:
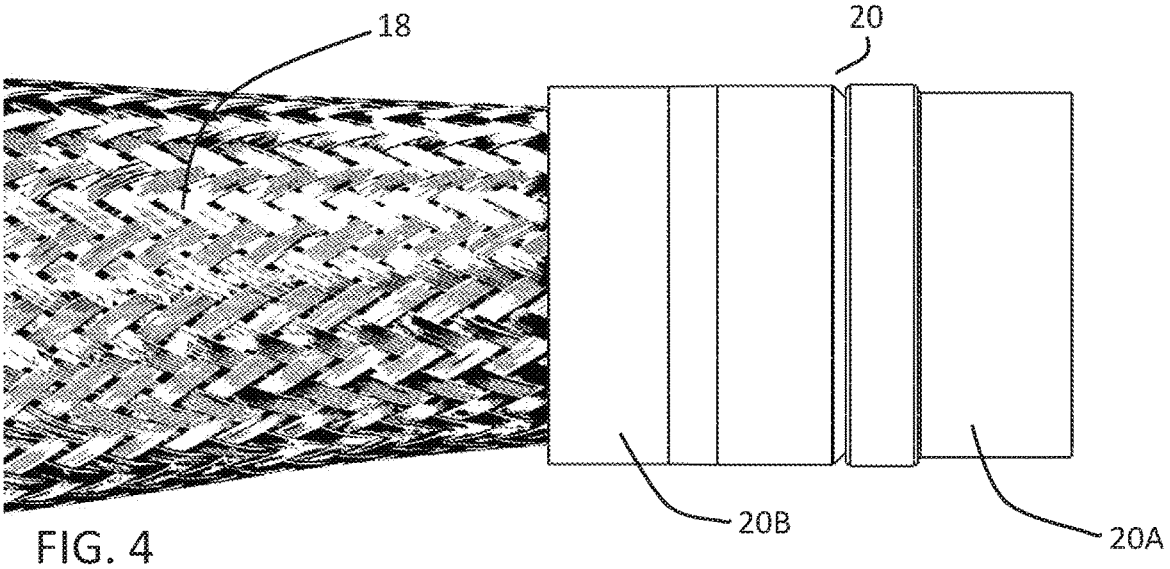
FIG. 4 shows an electrical connector on an end of the electrical conductor in more detail.

FIG. 4 shows an electrical conductor 18 cut to a selected length and having an electrical connector 20 affixed to the cut end. The electrical conductor 18 may be formed, for example and without limitation, into a braid having closed circumference tube shape. The selected length and the structure of the braid may be such that the electrical conductor 18 is longer than the distance between the recesses (12B, 14B in FIG. 2), and when radially expanded to conform to the interior surface of the pipe joint (10 in FIG. 3A, as will be explained further below, contracts so that an assembly comprising the electrical conductor 18 and electrical connectors at each longitudinal end substantially matches the distance between the recesses (12B, 14B in FIG. 2). By using braided material for the electrical conductor 18, the electrical conductor 18 may be more easily made to conform to the interior surface of the pipe joint (10 in FIG. 1) during final assembly, and may have better resistance to fatigue failure during use of the drill string wherein bending stresses are applied to the drill string. In some embodiments, the structure of the braid and the material from which the electrical conductor is made are such that when the electrical conductor 18 is radially expanded inside the pipe joint 10, the electrical conductor 18 undergoes substantially no plastic deformation. Using braided material may also reduce the force required to expand the electrical conductor 18 and to keep it in place during manufacture of the pipe joint. Using braided material may also reduce the force required to longitudinally extend the electrical conductor when the pipe joint 10 is subjected to tension. The electrical conductor 18 may be made from electrically conductive materials such as, for example and without limitation, copper, aluminium, steel and mixtures thereof.

It should be understood for purposes of defining the scope of the present disclosure that braid, whether in tube shape or other shape, is only one possible structure for the electrical conductor 18. Other structures, for example helical winding, multiple helical winding in the same or in opposed lay directions may be used to equal effect. For purposes of defining the scope of the present disclosure, the structure of the electrical conductor 18 may be any structure that may be conformed to the interior surface of the pipe joint 10 by radial expansion and may undergo full radial expansion inside the pipe joint 10 substantially without plastically deforming, that is, the material of the electrical conductor 18 is not strained beyond its elastic limit under such radial expansion to conform to the interior of the pipe joint 10. In some embodiments, the electrical conductor 18 may be shaped such that when attached to the interior of the pipe joint, the electrical conductor 18 is below its elastic limit when the pipe joint undergoes maximum permissible strain, whether bending, torsional or longitudinal.

Figure 5:
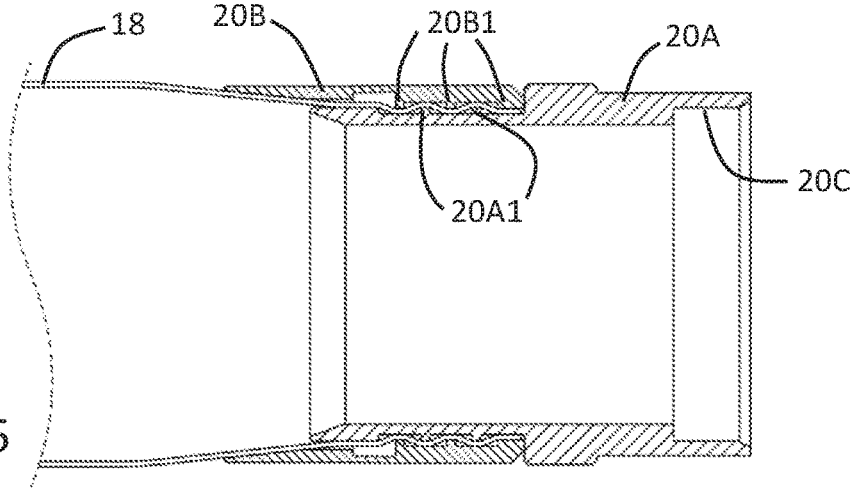
FIG. 5 shows a cross-section of a female electrical connector crimped onto an end of the electrical conductor.

FIG. 5 shows a cross-section of a female electrical connector 20 crimped onto an end of the electrical conductor 18. The interior surface of a retaining sleeve 20B portion of the electrical connector 20 may include retaining features 20B1 that engage corresponding retaining features 20A1 in a contact portion 20A, e.g., rings and grooves, such that when the retaining sleeve 20B is crimped, the electrical conductor 18 is gripped tightly in place in the electrical connector 20 so as to have substantial longitudinal "pull out" strength. The electrical connector 20 shown in FIG. 4 and FIG. 5 is a female connector that may be disposed in the recess (14B in FIG. 2) in the pin (14 in FIG. 1) when the electrical connector 18 is assembled to the pipe joint (10 in FIG. 1). The female electrical connector 20 may include a recess 20C for receiving an electrical contact (FIG. 10) from an adjacent male electrical connector (FIG. 8B) when two pipe joints 10 are threadedly connected to each other end to end.

Figure 6:
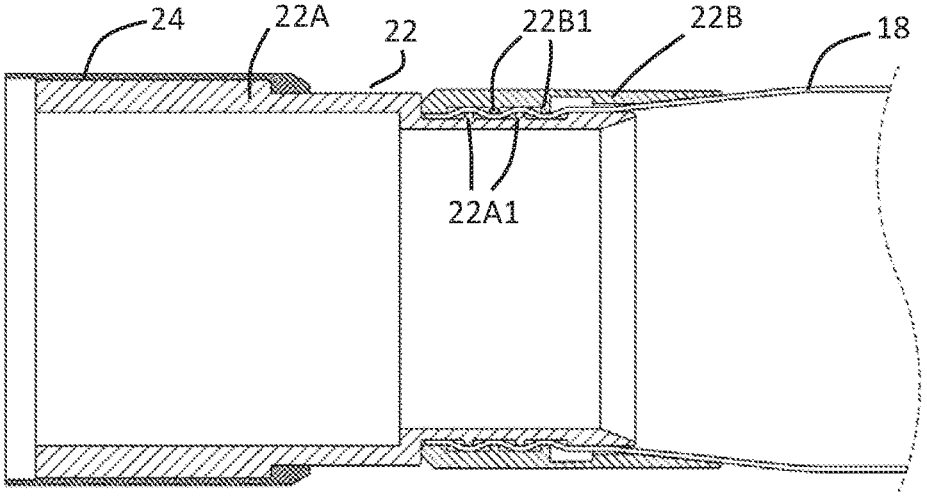
FIG. 6 shows a cross-section of a male electrical connector crimped to the other end of the electrical conductor, wherein an electrical insulator is applied to an exterior of the electrical connector.

FIG. 6 shows a cross-section of a male electrical connector 22 crimped to the other longitudinal end of the electrical conductor 18, wherein an electrical insulator 24 is applied to an exterior of the male electrical connector 22. The male electrical connector 22 may comprise a contact portion 22A and a retaining ring 22B each with similar retaining features 22A1, 22B1 as may be used for the female electrical connector (20 in FIG. 5). The electrical insulator 24 may be made from any suitable material, it being understood that the electrical insulator 24 is intended to keep the male electrical connector 22 from making physical contact with the interior of the pipe joint (10 in FIG. 1) while having some degree of flexibility and compressibility such that the electrical insulator 24 will not crack or break during assembly and disassembly of adjacent pipe joints (10 in FIG. 1), and will not crack or break as a result of bending stresses applied to the drill string while in use in drilling a wellbore. One such material that may be used for the electrical insulator 24 in some embodiments is polyether ether ketone (PEEK). PEEK is only one example of an electrically insulating material that may be used for the electrical insulator 24 and is not to be construed as a limit on the scope of the present disclosure.

Figure 7:
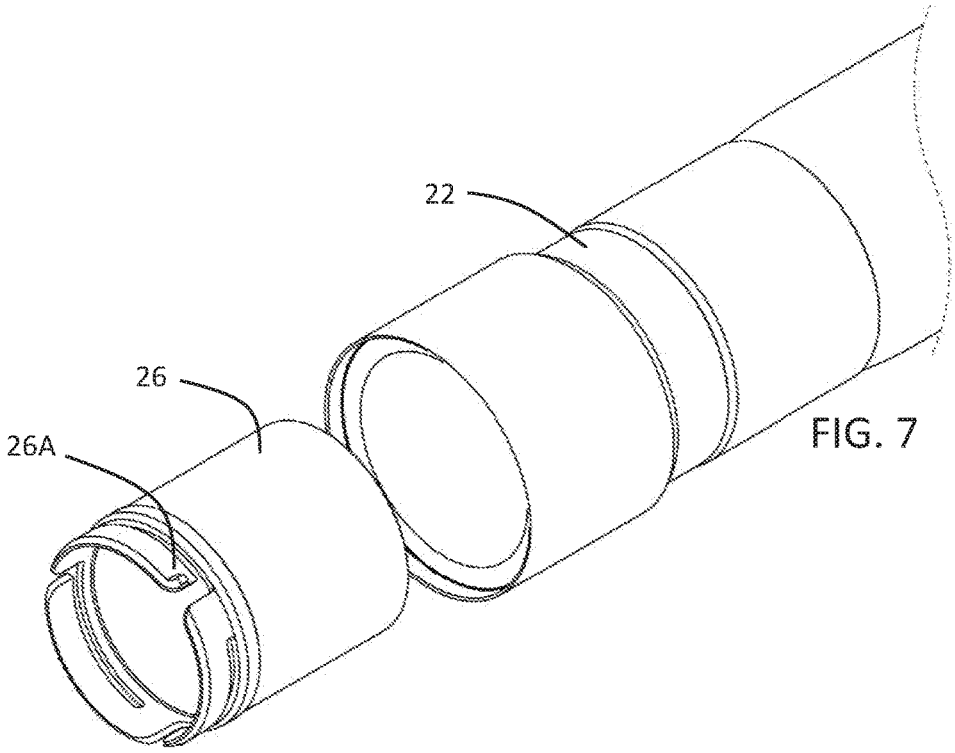
FIG. 7 shows an electrical contact being inserted into the male electrical connector.

FIG. 7 shows an electrical contact 26 being inserted into the male electrical connector 22. In some embodiments, the electrical contact 26 may be shrink fit, e.g., by cooling and then inserting the electrical contact 26 into the interior surface of the male electrical connector 22. The electrical contact 26 may be press fit, e.g., have an interference fit inside the male electrical connector 22. The electrical contact 26 may include biased contacts 26A that engage the interior surface of the female electrical connector (20 in FIG. 5) when adjacent pipe joints are assembled. The electrical contact 26 may be made, for example and without limitation, from suitable spring steel or phosphor bronze, for example so that when the biased contacts 26A are disposed inside the female electrical connector (20 in FIG. 5), the biased contacts 26A make firm mechanical contact (and thereby good galvanic electrical contact) with the interior surface of the female electrical connector (20 in FIG. 5).

Figure 8A:
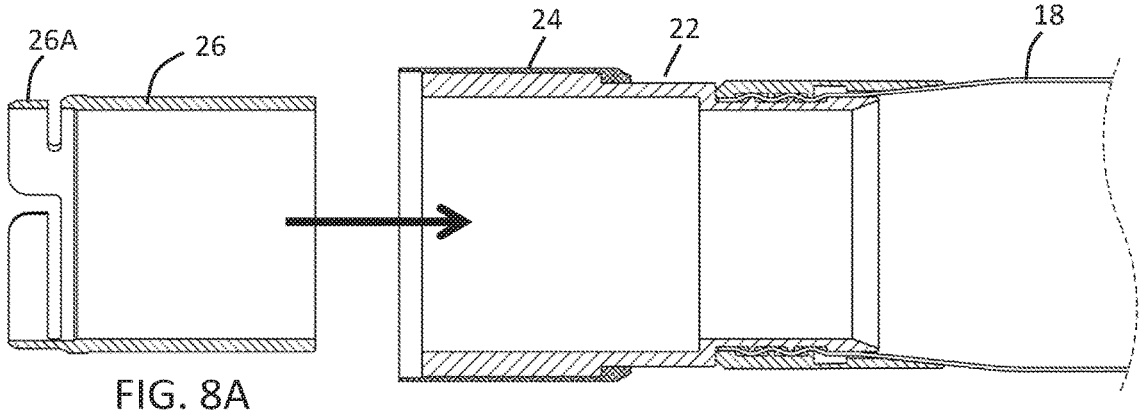
FIG. 8A shows an exploded view of the male electrical connector, electrical contact, insulator and electrical conductor.
Figure 8B:
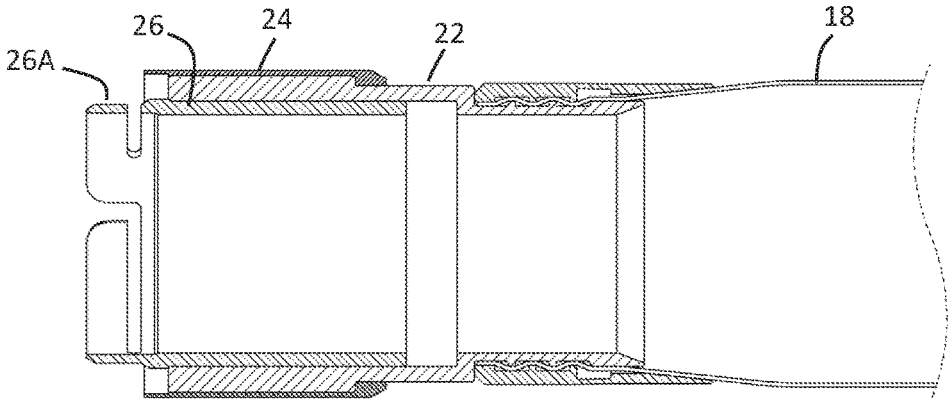
FIG. 8B shows an assembled view of the components shown in FIG. 8A.

FIG. 8A shows an exploded view of the male electrical connector 22, electrical contact 26, insulator 24 and electrical conductor 18. As indicated by the arrow in FIG. 8A, the electrical contact is moved into its final position inside the male electrical connector. One possible advantage of having the male electrical connector 22 and the electrical contact 26 as separate components is to facilitate reworking of the threads on the pipe joint 10 when needed. FIG. 8B shows the foregoing components assembled to each other.

Figure 9:
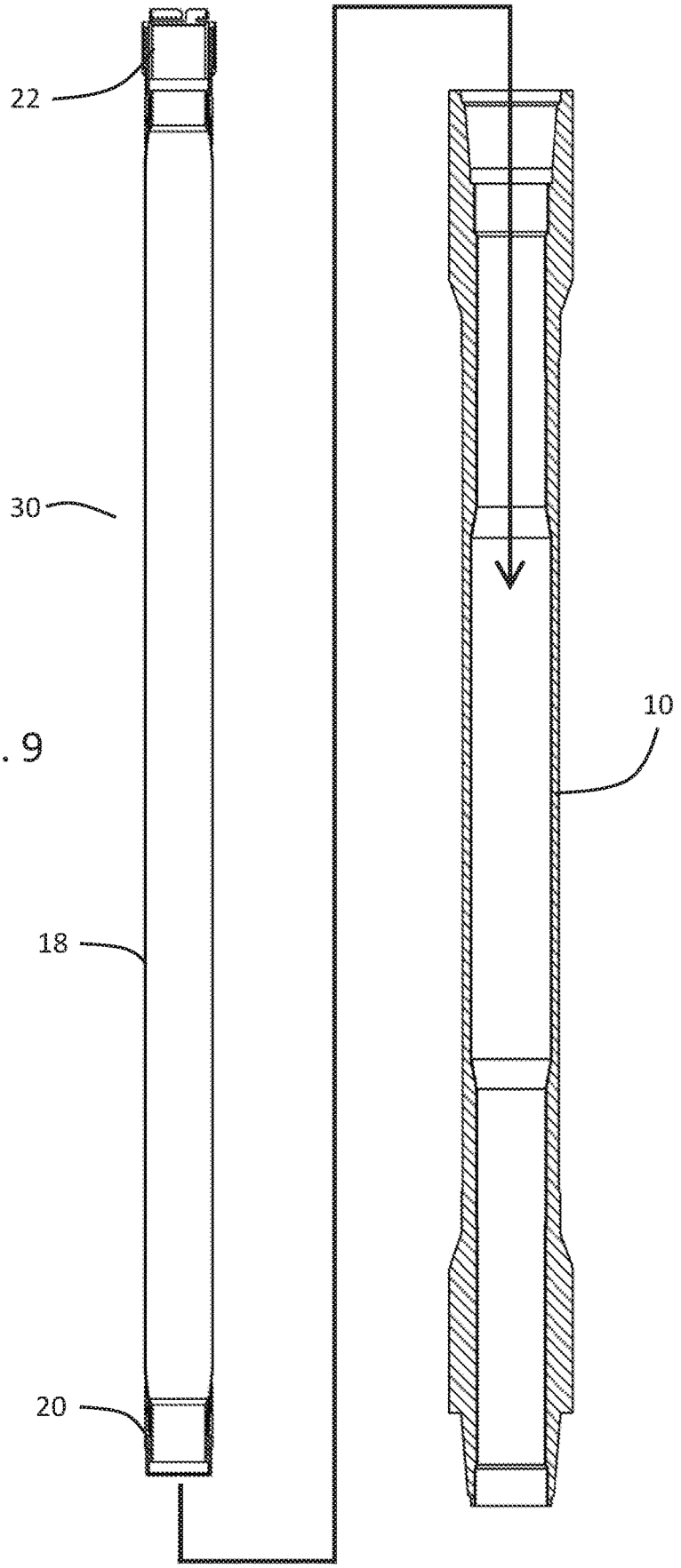
FIG. 9 shows inserting the electrical conductor with connectors at both longitudinal ends into the pipe joint of FIG. 3.

FIG. 9 shows an electrical conductor assembly 30 comprising the electrical conductor 18, attached female electrical connector 20 and attached male electrical connector 22 assembled to a pipe joint (10 in FIG. 1) as explained with reference to FIGS. 4 through 8B. As shown in FIG. 9, the electrical conductor assembly 30 may be inserted into the pipe joint formed and/or machined as explained with reference to FIG. 2 and FIG. 3.

Figure 10:
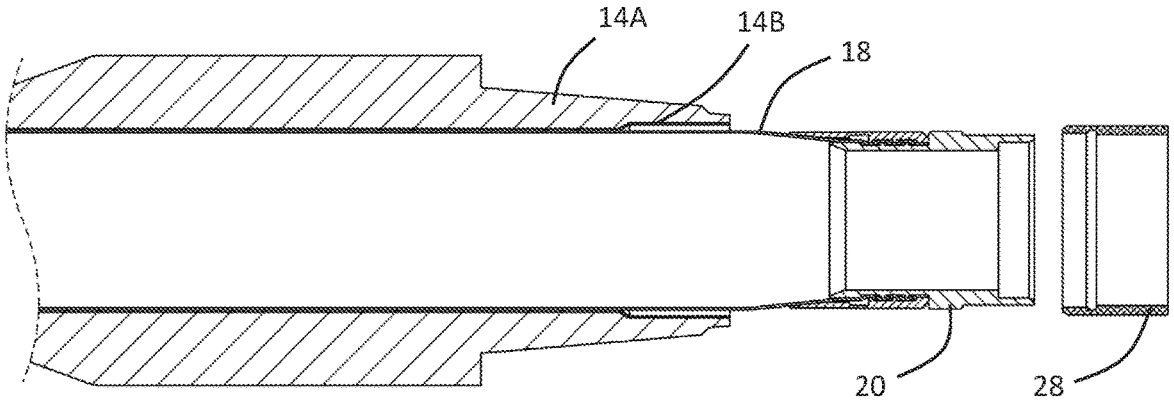
FIG. 10 shows an electrical insulator being affixed to an exterior of the female electrical connector after the assembly of FIG. 9 is fully inserted into the pipe joint.

FIG. 10 shows an electrical insulator 28 being affixed to an exterior of the female electrical connector 20 after the assembly (30 in FIG. 9) of FIG. 9 is fully inserted into the pipe joint (10 in FIG. 9). The electrical insulator 28 may be made from a material having similar mechanical and electrical properties as the electrical insulator explained with reference to FIGS. 6 through 8B.

Figure 11:
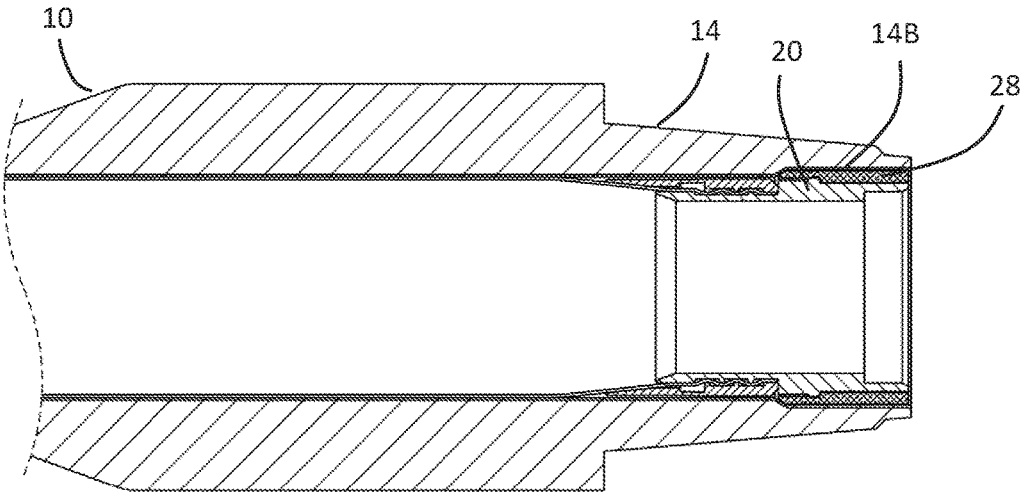
FIG. 11 shows the female electrical connector seated in a receptacle in the pin end of the pipe joint formed by the process explained with reference to FIG. 2.

FIG. 11 shows the female electrical connector 20 seated in the receptacle 14B in the pin end 14 of the pipe joint 10 formed by the process explained with reference to FIG. 2.

Figure 12:
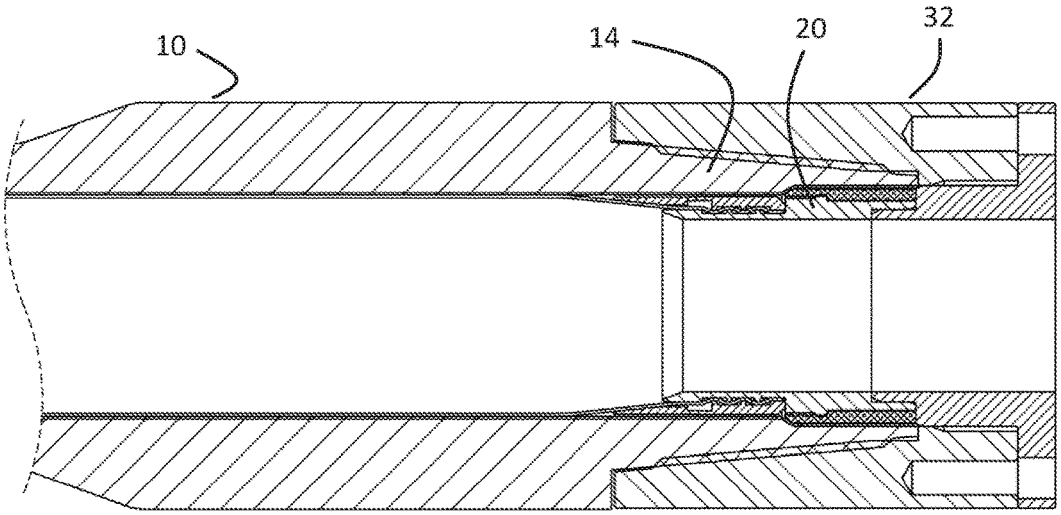
FIG. 12 shows a retaining sub attached to the pin end of the pipe joint to hold the female electrical connector in place.

FIG. 12 shows a retaining sub 32 attached to the pin end 14 of the pipe joint 10 to hold the female electrical connector 20 in place during final assembly of the pipe joint 10.

Figure 13:
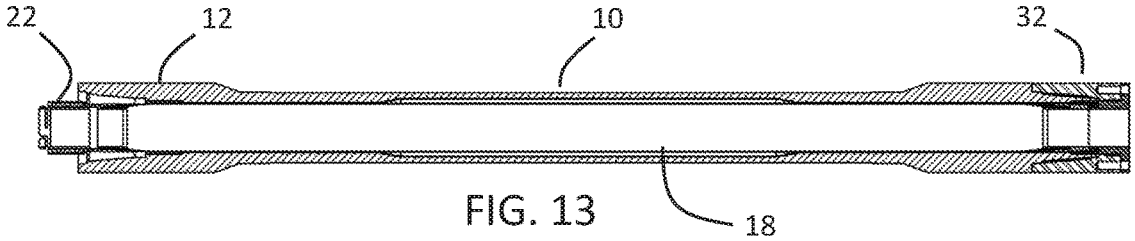
FIG. 13 shows the male electrical connector protruding from the box end of the pipe joint prior to radial expansion of the electrical conductor.

FIG. 13 shows the male electrical connector 22 protruding from the box end 12 of the pipe joint 10 prior to radial expansion of the electrical conductor 18.

Figure 14:
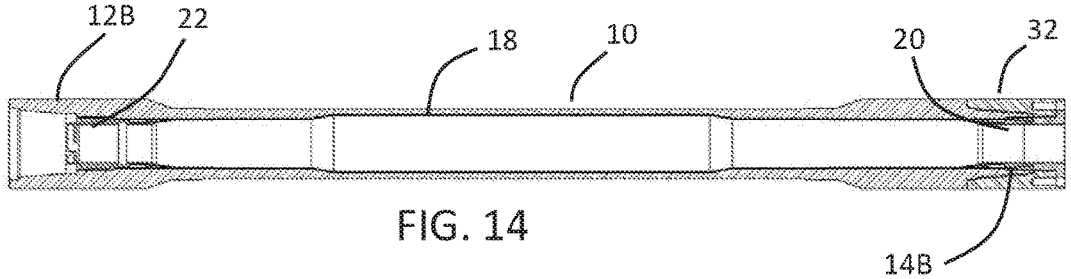
FIG. 14 shows the male and female electrical connectors in their fully seated positions in corresponding features in the pipe joint after radial expansion and consequent longitudinal contraction of the electrical conductor.

FIG. 14 shows the male 22 and female 20 electrical connectors in their respective fully seated positions in corresponding features 12B, 14B in the pipe joint 10 after radial expansion and consequent longitudinal contraction of the electrical conductor 18. The electrical conductor 18 may be radially expanded to conform to the interior surface of the pipe joint 10. Any known device or technique may be used for radial expansion of the electrical conductor such as hydraulic or pneumatic bladder expansion, application of an internal roller expander, among other techniques. As previously explained, the length of the electrical conductor 18 may be selected such that upon full radial expansion of the electrical conductor 18 to conform the interior surface of the pipe joint 10, the longitudinal dimension of the electrical conductor 18 and the assembled electrical connectors 22, 20 is substantially equal to the longitudinal distance between the recesses 12B, 14B.

Figure 15:
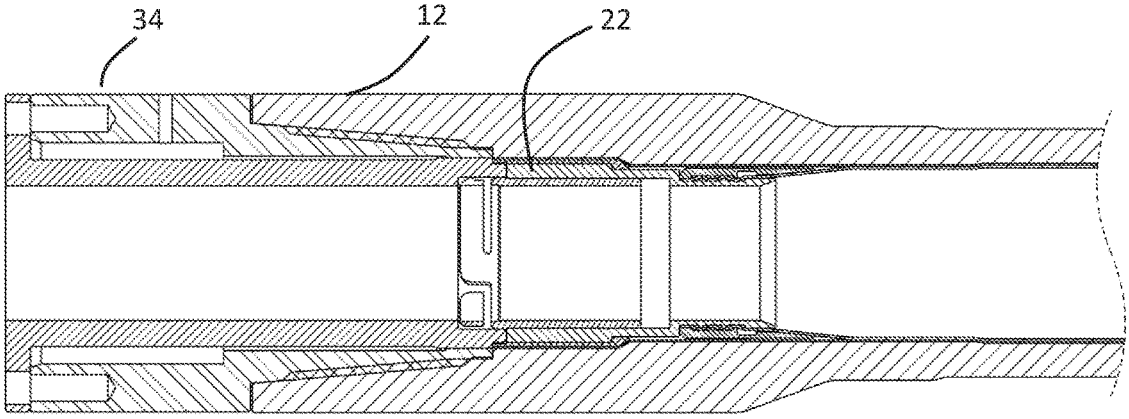
FIG. 15 shows a retaining sub attached to the box end of the pipe joint.
Figure 16:
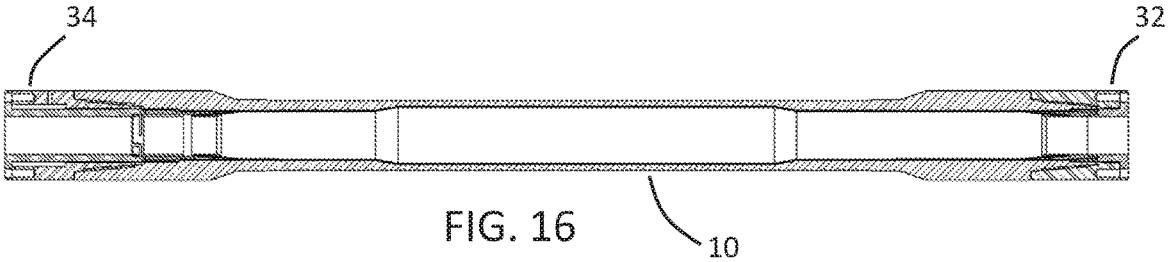
FIG. 16 shows the assembled pipe joint with retaining subs at both ends during cure of a structural material.

FIG. 15 shows a retaining sub 34 attached to the box end 12 of the pipe joint 10. By having retaining subs at both longitudinal ends of the pipe joint, the electrical conductor assembly (30 in FIG. 9) is fixed in its assembled position during cure of insulating bonding material, e.g., the material explained with reference to FIG. 3 or any other curable bonding material. In some embodiments, the material may be omitted from the exterior of the electrical conductor assembly; the material coated on the interior of the pipe joint as shown in FIG. 3 will be sufficient. FIG. 16 shows the assembled pipe joint with retaining subs 32, 34 at both ends during cure of the insulating material. After the insulating material is cured, the retaining subs 32, 34 may be removed.

Figure 17:
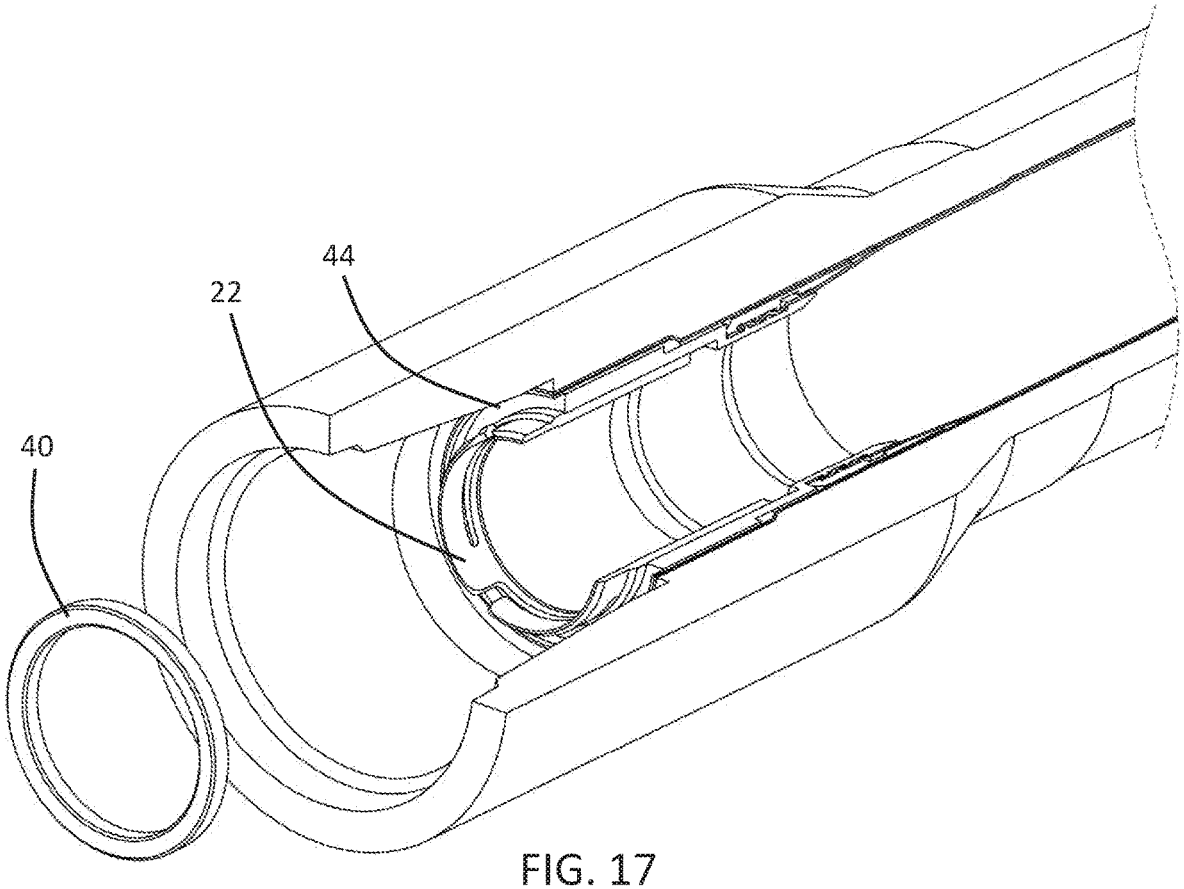
FIG. 17 shows placement of an electrical insulator in a feature formed therefor on an exterior of the male electrical connector.

FIG. 17 shows placement of an electrical seal and insulator 40 in a feature 44 formed therefor on an exterior of the male electrical connector 22. Thus, when the pipe joint is assembled to another pipe joint, the electrical seal and insulator 40 fluidly seals the space between the interior of the connected box and pin ends and the electrical connectors 22 and 20 from FIG. 5 and FIG. 6, respectively.

Figure 18A:
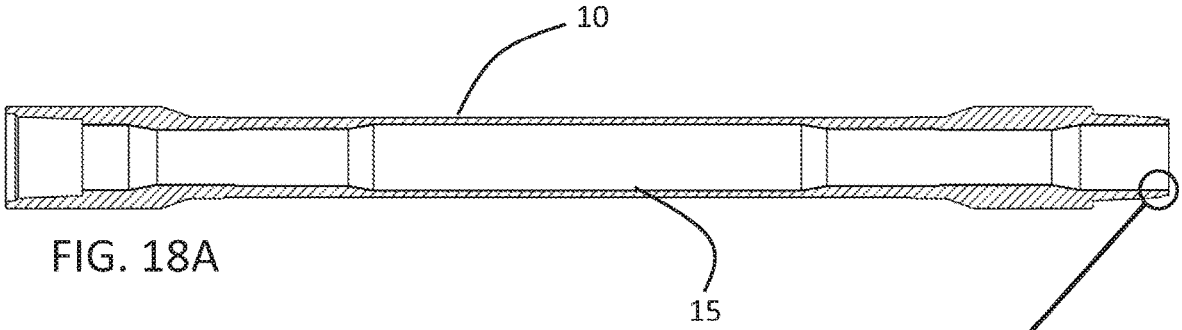
FIG. 18A shows another embodiment of a pipe joint including a non-ferromagnetic, electrically conductive coating on an interior surface.
Figure 18B:
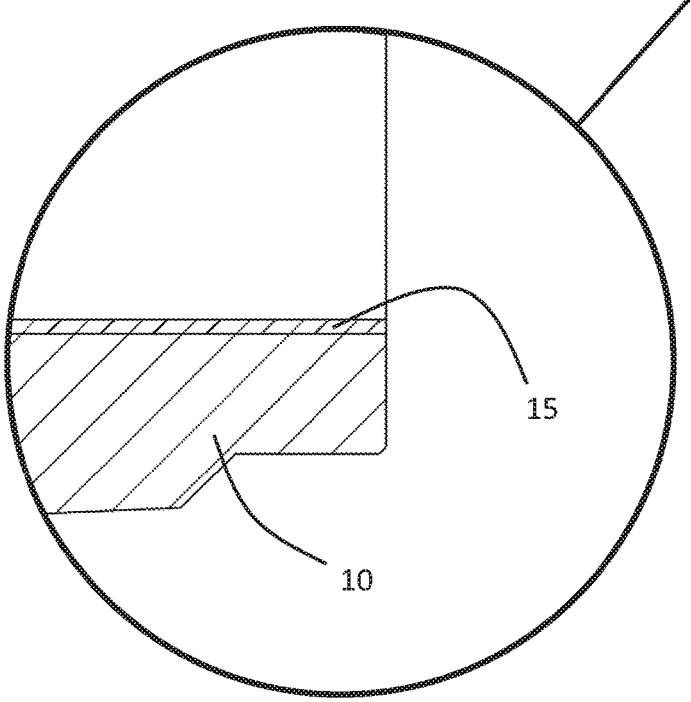
FIG. 18B shows a detailed section of the pipe joint of FIG. 18A.

It has been determined through experimentation that the highest frequency alternating current (AC) that can be transmitted over a pipe made as explained with reference to FIGS. 1 through 17 may be limited. The cause is believed to be counter electromotive force induced by passing AC through a ferromagnetic pipe joint. Referring to FIG. 18A, one embodiment of a pipe according to the present disclosure may be capable of transmitting higher frequency AC. In the present embodiment, the bare pipe joint 10 may be coated on its inner surface by an electrically conductive, non-ferromagnetic material 15 prior to installation of other components as described with reference to FIGS. 1 through 17. Examples of such materials may include, without limitation, metals such as aluminium and copper and mixtures thereof. The thickness of the electrically conductive, non-ferromagnetic material 15 may vary depending on the dimensions and wall thickness of the pipe joint 10 and the maximum AC frequency required to be transmitted along a string of such pipe joints. FIG. 18B shows the pipe joint 10 and the electrically conductive, non-ferromagnetic material 15 coating in greater detail.

Figure 19A:
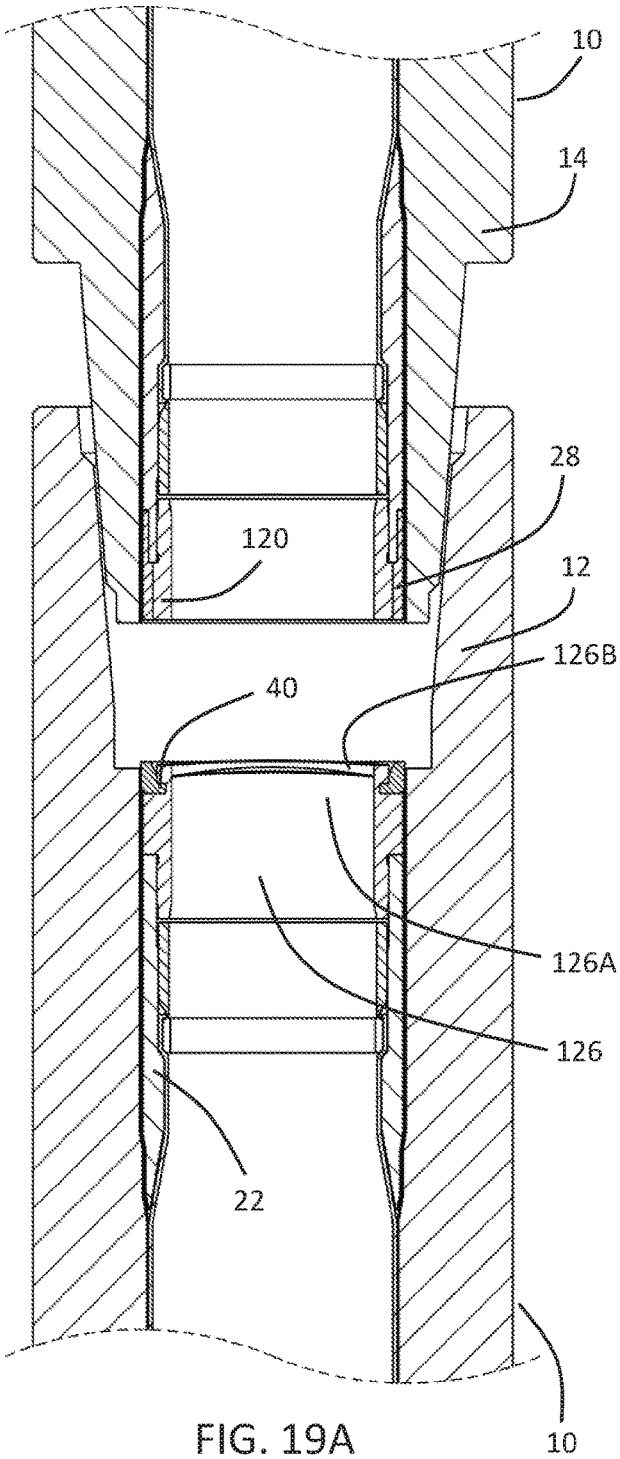
FIGS. 19A, 19B, 19C and 19D show another example embodiment of an electrical connector.
Figure 19B:
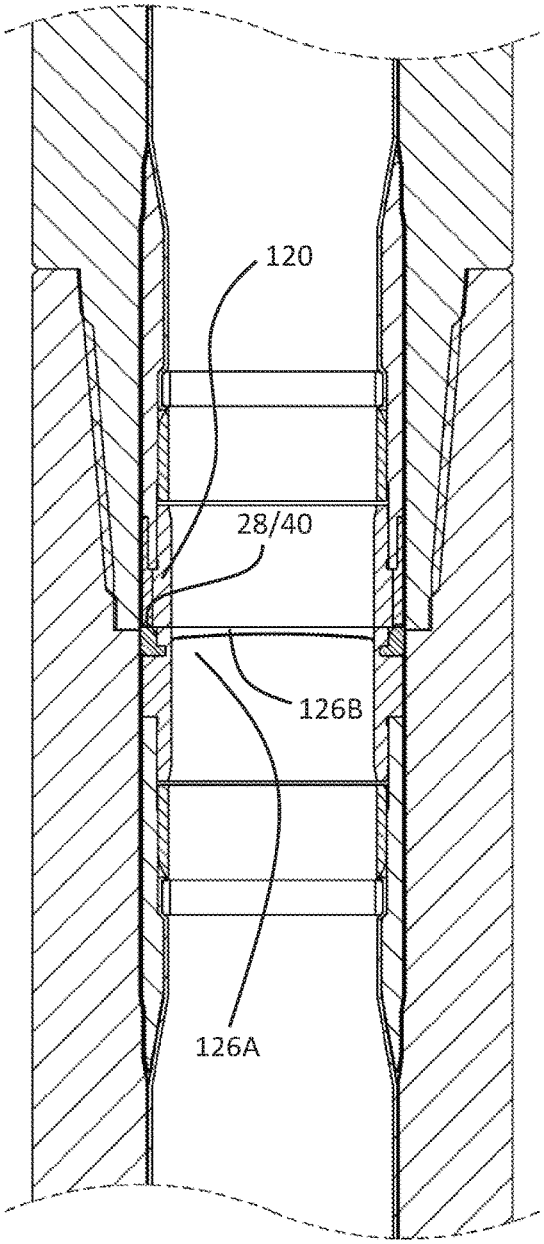

FIGS. 19A, 19B, 19C and 19D show another example embodiment of an electrical connector. FIG. 19A shows two adjacent pipe joints 10 in the process of being threadedly coupled to each other end to end. The upper pipe joint 10 in FIG. 19A and FIG. 19B is shown at its pin end 14. The pin end 14 may have features machined on its interior surface for receiving a pin end electrical contact 120. The pin end electrical contact 120 may be assembled to the electrical conductor (18 in FIG. 10) as explained with reference to FIGS. 5 and 6, or may be assembled to the electrical conductor (18 in FIG. 10) as will be further explained below. The pin end electrical contact 120 may be surrounded on its exterior surface by an insulator 28, similar to the structure shown in and explained with reference to FIG. 10.

The lower pipe joint 10 is shown at its box end 12. The box end may be configured substantially as explained with reference to FIGS. 6 through 8B and may comprise a box end electrical connector 22 having an insulator 24 disposed on the exterior surface of the box end electrical connector 22. The box end electrical connector 22 may comprise a seal/insulator 40 proximate the axial end of the box end electrical connector 22. Such seal/insulator 40 may in some embodiments be configured substantially as explained with reference to FIG. 17. An electrical contact 126 may be disposed inside an interior surface of the box end electrical connector 22. The electrical contact 126 may be interference fit into the box end electrical connector 22 or otherwise assembled to the box end electrical connector 22 so that the electrical contact 126 is removable for service of the pipe joint 10 but will remain in place in the box end electrical connector 22 during ordinary use of a drill pipe assembled from a plurality of pipe joints as described herein, such use including threadedly coupling and uncoupling of adjacent pin and box ends of respective pipe joints.

The electrical contact 126 may comprise a contact body 126A that may be assembled to the box end electrical connector 22, e.g., by interference fit, and a contact ring 126B disposed at a longitudinal end of the electrical contact body 126A. FIG. 19B shows the pipe joints 10 when the pin end 14 of one of the pipe joints 10 is fully threadedly engaged with the adjacent pipe joint box end 12. As may be observed in FIG. 19B, when the box end 12 of one pipe joint 10 is fully threadedly engaged with the pin end 14 of the adjacent pipe joint 10, the contact ring 126B is compressed axially so as to engage a longitudinal end of the pin end electrical contact 120 in the adjacent pipe joint. Such engagement provides an electrically conductive path for the electrical conductors in the adjacent pipe joints. In FIG. 19B, the insulator 28 surrounding the electrical contact 120 is compressed against the seal/insulator 40 at the longitudinal end of the contact ring 126B.

Figure 19C:
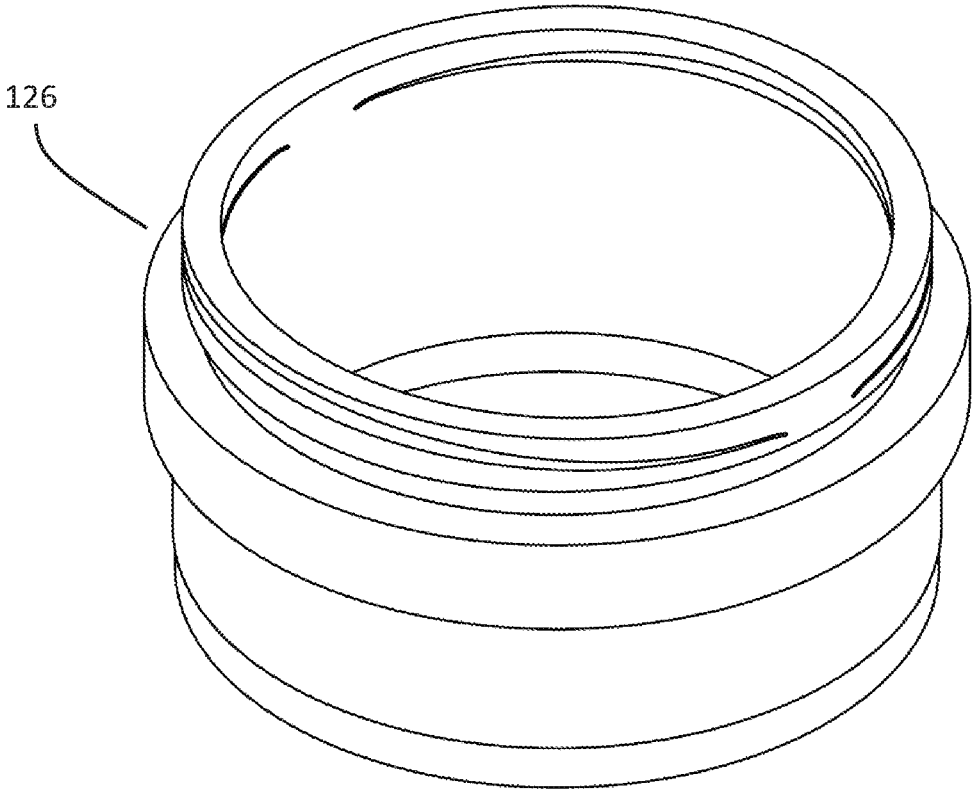
Figure 19D:
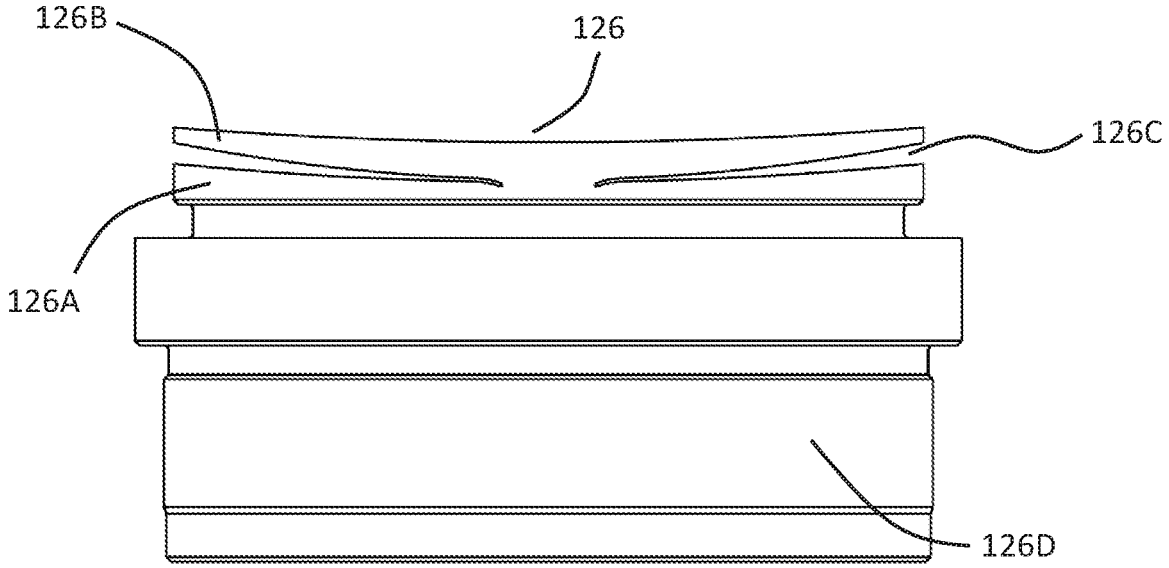

FIG. 19C shows the electrical contact 126 in more detail. The electrical contact body 126A may include a portion thereof 126D which may be assembled, e.g., interference fit to the box end electrical connector (22 in FIG. 21A). The electrical contact body 126A may include a flange at a longitudinal end of the electrical contact body 126A that may be cut or otherwise formed to create the contact ring 126B from the flange. In the present example embodiment, a wedge shaped recess 126C on opposed circumferential sides of the electrical contact body 126A may be formed, e.g., by electrode discharge machining, so that the contact ring 126B when axially compressed against the axial end face of the pin end electrical contact (120 in FIG. 19A) the contact ring 126B may deflect as a result of the axial force applied to the contact ring 126B. In the present embodiment, the electrical contact 126 may be made from an electrically conductive material having an elastic limit that is lower than the bending strain applied to the contact ring 126B when it is compressed against the pin end electrical contact (120 in FIG. 19A).

Figure 20A:
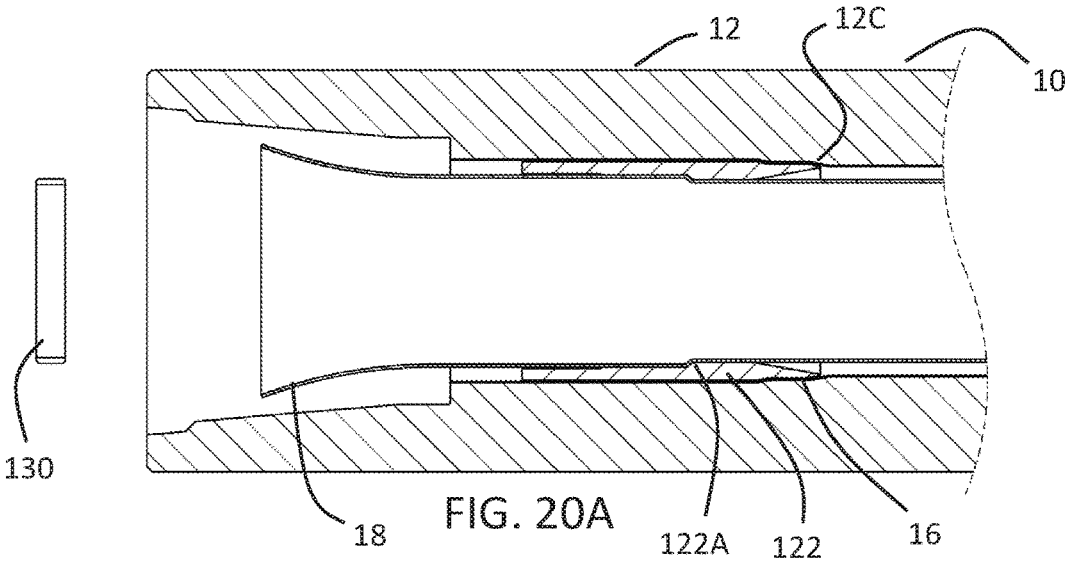
FIGS. 20A through 20F show a different embodiment of engaging an electrical connector to a longitudinal end of the electrical conductor.

FIGS. 20A through 20F show another embodiment of electrical terminations for the electrical conductor 18. In the present embodiment, the electrical conductor 18 may be cut to a length that includes free ends extending beyond the longitudinal ends of electrical connectors disposed in the pin end and the box end, even after radial expansion of the electrical conductor 18 to conform to the inner surface of the pipe joint 10, pin end (14 in FIG. 12) and the box end 12. Referring to FIG. 20A, the box end 12 of a wired pipe joint 10 includes the electrical conductor 18 radially expanded to conform to the inner surface of the pipe joint 10, wherein the electrically insulating layer 16 is affixed to the interior surface of the pipe joint 10 prior to insertion of the electrical conductor 18. As explained with reference to FIGS. 18A and 18B, in some embodiments, the interior surface of the pipe joint 10 may comprise a non-ferromagnetic, electrically conductive material disposed on such surface prior to affixing the insulating material 16. An electrical connector 122 may be shaped to conform to an interior surface of the pipe joint 10 such that the electrical connector 122 may be inserted into the box end 12 and stopped from further axial movement into the pipe joint 10 by, for example, an inwardly tapered surface 12C. Other possible embodiments of an axial stop for the electrical connector 122 may comprise, without limitation, an inwardly projecting shoulder. When fully inserted into the pipe joint 10, the electrical connector 122 may be disposed against the insulating material 16. The electrical conductor 18 is disposed inside the interior surface of the electrical connector 122.

In the present embodiment, once the electrical connector 122 is in place and the electrical conductor 18 is in place extending through the interior of the electrical connector, a locking ring 130 may be urged into the interior of the electrical conductor 18 until the locking ring 130 is stopped from further axial movement inwardly by a retaining feature 122A formed in the interior of the electrical connector 122. When the locking ring 130 is fully inserted into the electrical connector 122, the electrical conductor 18 is retained in place longitudinally by the locking ring 130. The electrical connector 122 may be electrically insulated from the interior surface of the box end 12 by an electrical insulator.

Figure 20B:
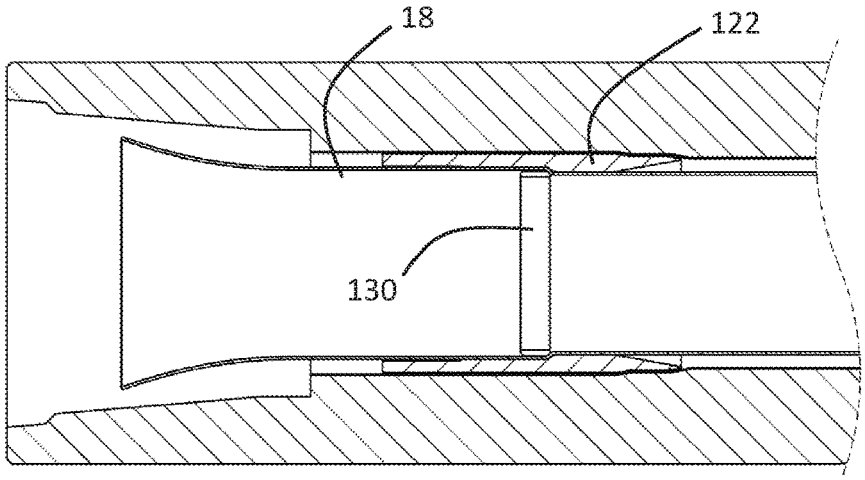

FIG. 20B shows a cross-section of the pipe joint 10 when the locking ring 130 is fully inserted into the electrical connector 122.

Figure 20C:
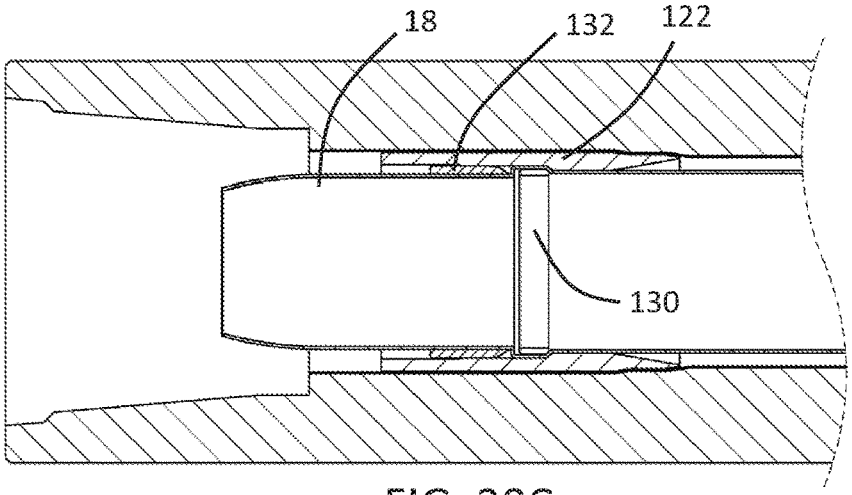

FIG. 20C shows insertion of a cutting ring 132 onto the exterior surface of the electrical conductor 18. The cutting ring 132 may comprise a longitudinal end (FIG. 22F) having a sharp edge which can cut the electrical conductor 18 when the cutting ring 132 is urged axially against a longitudinal edge of the locking ring 130, with the electrical conductor 18 interposed between the locking ring 130 exterior surface and the cutting ring 132 interior surface. An outer diameter of the cutting ring 132 in some embodiments may be selected to provide an interference fit between the cutting ring 132 and the interior surface of the electrical connector 122. FIG. 20C shows the cutting ring partially inserted into the box end 12 prior to engaging the cutting surface (FIG. 20F).

Figure 20D:
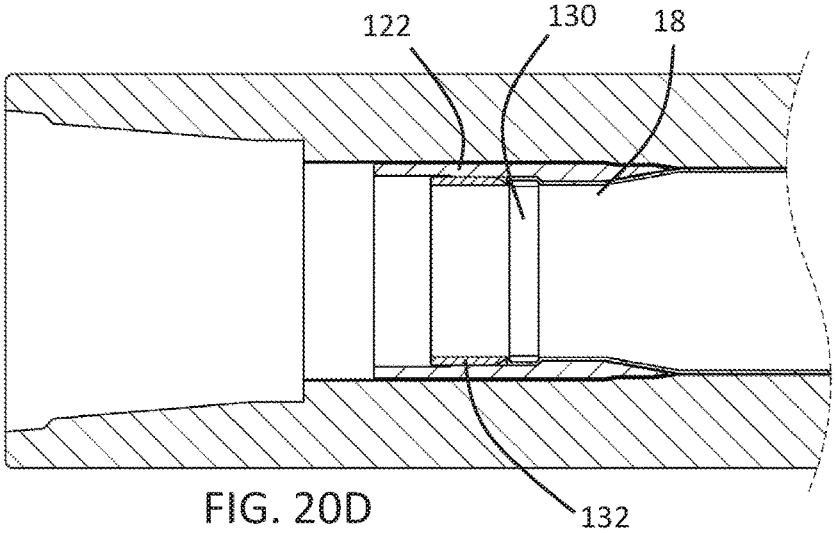
Figure 20E:
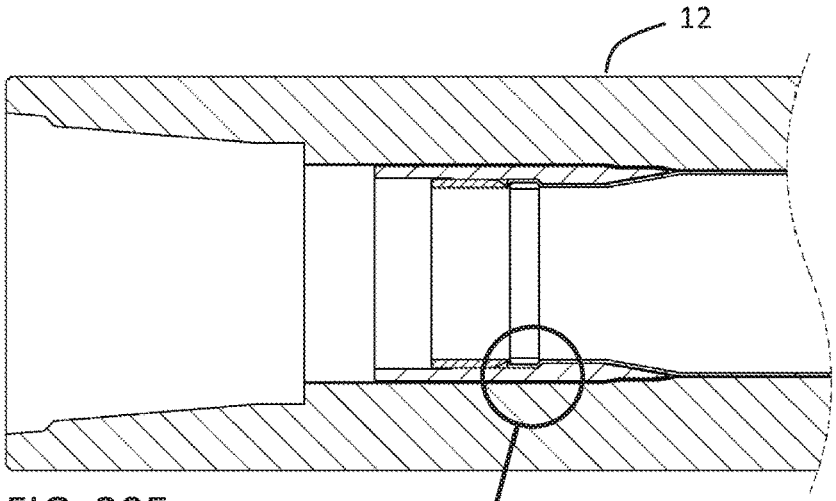
Figure 20F:
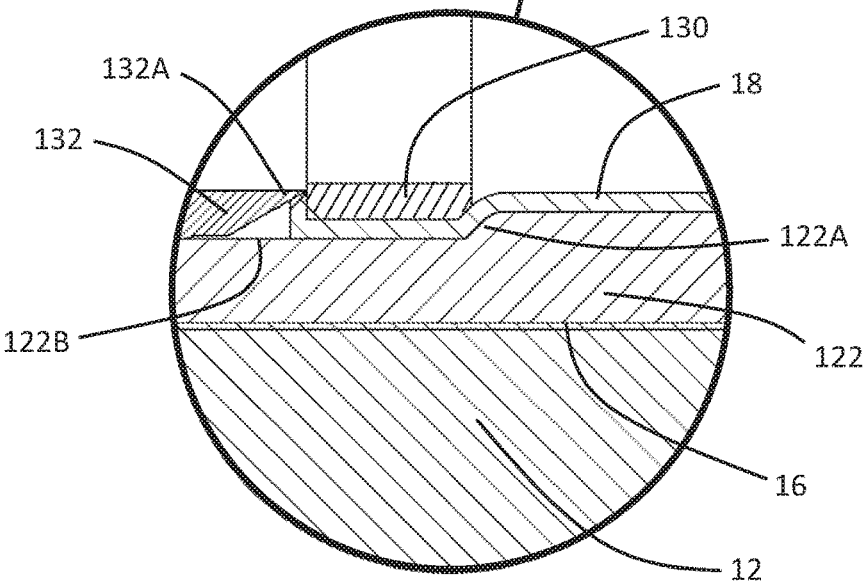

FIG. 20D shows the cutting ring 132 fully inserted into the electrical connector 122 such that the cutting ring 132 is longitudinally adjacent to the locking ring 130, wherein a portion of the electrical conductor 18 that extended beyond the cutting ring 132 has been sheared off and removed. After shearing and removal of such excess portion of the electrical conductor 18, an insulating/seal ring 40 may be inserted into the box end until it engages the electrical insulating material (16 in FIG. 3). FIG. 20E shows the assembled electrical conductor 18, electrical connector 122, locking ring 130 and the cutting ring 132, to show the position of an expanded view of the foregoing in FIG. 20F. FIG. 20F shows the retaining feature 122A on the interior surface of the electrical connector 122. The locking ring 130 is shown urged toward the retaining feature 122A so as to retain the electrical conductor 18 in place. The cutting ring 132 is shown in detail as having a sharp edge 132A that shears off the portion of the electrical conductor 18 that extends outwardly from the box end 12 beyond the sharp edge 132A. The interior surface 122B of the electrical connector 122 may form a receptacle for an electrical contact such as explained with reference to FIG. 7 or FIG. 19C.

Termination of the electrical conductor 18 at the pin end (14 in FIG. 11) in some embodiments may be made substantially as explained with reference to FIGS. 20A through 20F.

Figure 21A:
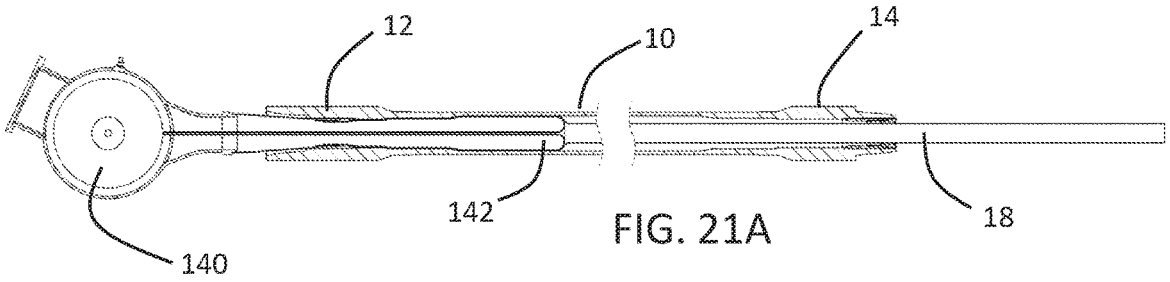
FIGS. 21A and 21B show an example embodiment of radial expansion of the electrical conductor.
Figure 21B:
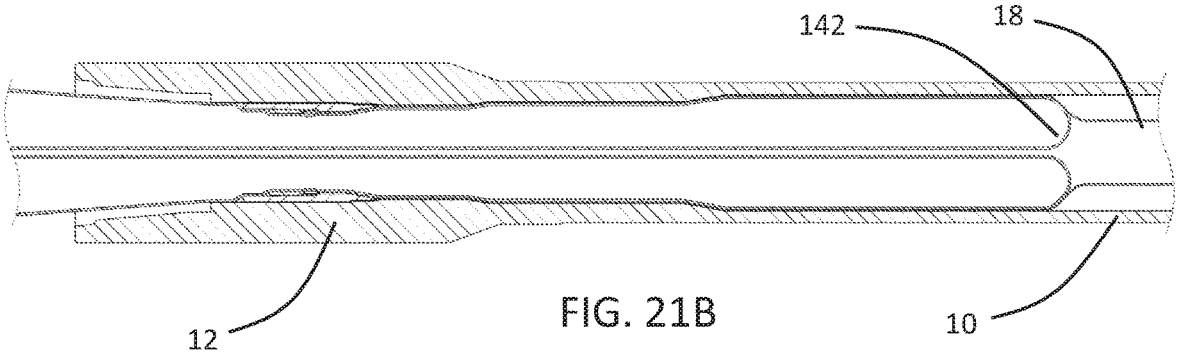

An example embodiment of a process for radially expanding the electrical conductor to conform to the interior surface of the pipe joint is shown schematically in FIGS. 21A and 21B. In FIG. 21A, the electrical conductor 18 may be assembled to the box end 12 of the pipe joint 10 substantially as explained with reference to FIGS. 20A through 20F. A free end of the electrical conductor 18 may extend outwardly from the pin end 14 of the pipe joint 10. A pressurized inversion liner 142 may be dispensed from a reel or drum 140 and expanded radially and longitudinally inside the interior of the electrical conductor 18 to cause the electrical conductor 18 to expand radially to conform to the interior surface of the insulating material 16. As explained with reference to FIGS. 9 through 13, the electrical conductor 18 may contract longitudinally as it is expanded radially. The free end of the electrical conductor 18 may extend from the pin end a sufficient distance such that when fully radially expanded, the electrical conductor 18 will extend longitudinally beyond its termination point in the pin end 14.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for making a wired drill pipe joint, comprising:

forming an electrically conductive material into a conduit structure, the conduit structure being internally hollow, radially expanding the conduit structure to conform to an interior surface of the wired drill pipe joint substantially without plastic deformation of the electrically conductive material, the conduit structure longitudinally contractible corresponding to radial expansion;

coupling an electrical connector to each longitudinal end of the conduit structure to form an electrical conductor assembly;

coating an interior surface of the wired drill pipe joint with an electrically insulating, bonding material;

inserting the electrical conductor assembly into the wired drill pipe joint; and radially expanding and correspondingly longitudinally contracting the electrically conductive material of the electrical conductor assembly to conform to the interior surface of the wired drill pipe joint.

2. The method of claim 1 further comprising curing the electrically insulating, bonding material.

3. The method of claim 1 wherein the electrically conductive material is helically wound.

4. The method of claim 1 wherein the electrically conductive material is formed into a braided tube.

5. The method of claim 1 wherein a length of the electrical conductor assembly is selected such that after radial expansion, the length is such that the electrical connector at each end of the electrically conductive material is disposed in a corresponding feature formed into the interior of a tool joint at each end of the wired drill pipe joint.

6. The method of claim 1 further comprising applying a layer of electrically conductive, non-ferromagnetic material on the interior surface of the wired drill pipe joint prior to the coating with an electrically insulating material.

7. The method of claim 6 wherein the material comprises at least one of aluminum, copper, steel and mixtures thereof.

8. The method of claim 1 wherein the electrical connector on a pin end of the wired drill pipe joint comprises a female electrical connector and the electrical connector on a box end of the wired drill pipe joint comprises a male electrical connector.

9. The method of claim 8 wherein the male electrical connector comprises a radially biased contact to radially engage an interior surface of the female electrical connector in an adjacent pipe joint.

10. The method of claim 8 wherein the male electrical connector comprises an axially biased contact to axially engage a longitudinal end of the female electrical connector.

11. The method of claim 10 wherein the axially biased contact is formed by making substantially wedge-shaped cuts in a flange on one longitudinal end of the male electrical connector, the substantially wedge shaped cuts providing an axially biased contact ring on a longitudinal end of the male electrical connector.

12. The method of claim 1 wherein the electrically conductive material is shaped such that when attached to the interior of the pipe joint, the electrically conductive material is below its elastic limit when the wired drill pipe joint undergoes maximum permissible bending, torsional or longitudinal strain.

13. A method for making a wired drill pipe joint, comprising:

forming an electrically conductive material into a conduit structure, the conduit structure being internally hollow, radially expanding the conduit structure to conform to an interior of the wired drill pipe joint substantially without plastic deformation of the electrically conductive material, the conduit structure longitudinally contractible corresponding to radial expansion;

coating an interior surface of the wired drill pipe joint with an electrically insulating, bonding material;

inserting the conduit structure into the wired drill pipe joint;

attaching an electrical connector to one longitudinal end of the electrically conductive material;

seating the electrical connector in a feature formed therefor in the interior surface of the wired drill pipe joint;

radially expanding and correspondingly longitudinally contracting the electrically conductive material to conform to the interior surface of the wired drill pipe joint;

coupling an additional electrical connector to another longitudinal end of the electrically conductive material; and seating the additional electrical connector on the another longitudinal end in a feature formed therefor on the interior surface of the wired drill pipe joint.

14. The method of claim 13 further comprising curing the electrically insulating, bonding material.

15. The method of claim 13 wherein the radially expanding the electrically conductive material comprises pressurizing an inversion liner inside the electrically conductive material after insertion thereof into the wired drill pipe joint.

16. The method of claim 13 wherein attaching the electrical connector or the additional electrical connector to either the one longitudinal end or the another longitudinal end comprises inserting a locking ring into an interior of the electrically conductive material proximate the one longitudinal end or the another longitudinal end until the locking ring is stopped by a retaining feature formed in the electrical connector or the additional electrical connector inserted into a corresponding longitudinal end of the wired drill pipe joint and inserting a cutting ring onto exterior of a portion of the electrically conductive material extending from the locking ring toward the corresponding longitudinal end of the wired drill pipe joint, the cutting ring inserted until a sharp edge thereon shears the electrically conductive material.

17. The method of claim 16 wherein the cutting ring is interference fit in an interior of the electrical connector.

18. The method of claim 13 wherein the electrically conductive material is shaped such that when attached to the interior of the wired drill pipe joint, the electrically conductive material is below its elastic limit when the wired drill pipe joint undergoes maximum permissible bending, torsional or longitudinal strain.

19. A method for terminating an electrical conductor disposed in a pipe joint, comprising:

inserting an electrical connector into the pipe joint until the electrical connector seats on a feature formed on an interior surface of the pipe joint;

inserting a radially expandable electrically conductive material into the interior of the pipe joint;

inserting a locking ring into an interior of the electrically conductive material until the locking ring seats on a feature formed in an interior surface of the electrical connector; and inserting a cutting ring onto the exterior of the electrically conductive material until a sharp edge on the cutting ring shears a part of the electrically conductive material extending from the locking ring.

20. The method of claim 19 wherein the cutting ring is interference fit inside the electrical connector.

21. The method of claim 19 further comprising inserting an electrical contact inside the electrical connector.

22. The method of claim 21 wherein the electrical contact comprises a radially biased surface for contacting an electrical connector in an adjacent pipe joint.

23. The method of claim 21 wherein the electrical contact comprises an axially biased surface for contacting an electrical connector in an adjacent pipe joint.

24. The method of claim 23 wherein the axially biased surface is formed by making substantially wedge-shaped cuts in a flange on one longitudinal end of electrical contact, the substantially wedge shaped cuts providing an axially biased contact ring on a longitudinal end of the electrical contact.

25. The method of claim 19 wherein the electrically conductive material is helically wound.

26. The method of claim 19 wherein the electrically conductive material is formed into a braided tube.

27. The method of claim 19 wherein a length of the electrical conductor assembly is selected such that after radial expansion, the length is such that an electrical connector at each end of the electrically conductive material is disposed in a corresponding feature formed into the interior of a tool joint at each end of the pipe joint.

28. The method of claim 19 further comprising applying a layer of electrically conductive, non-ferromagnetic material on the interior surface of the pipe joint prior to the coating with an electrically insulating material.

29. The method of claim 28 wherein the material comprises at least one of aluminum, copper, steel and mixtures thereof.

30. A method for making a wired drill pipe joint, comprising:

forming an electrically conductive material into a conduit structure, the conduit structure being internally hollow, radially expanding the conduit structure to conform to an interior of the wire drill pipe joint substantially without plastic deformation of the electrically conductive material;

inserting the conduit structure into the wired drill pipe joint; and radially expanding the conduit structure to conform to an interior surface of the wired drill pipe joint, wherein the radially expanding comprises internally pressurizing an inversion liner disposed inside the conduit structure.

31. The method of claim 30 further comprising coating the interior surface of the wired drill pipe joint with electrically insulating material prior to inserting the electrically conductive material.

32. The method of claim 31 wherein the electrically insulating material comprises capacity to bond to the electrically conductive material while maintaining electrical insulation from the interior of the wired drill pipe joint.

33. The method of claim 30 wherein the electrically conductive material is shaped such that when attached to the interior of the wired drill pipe joint, the electrically conductive material is below its elastic limit when the wired drill pipe joint undergoes maximum permissible bending, torsional or longitudinal strain.

* * * * *